United States Patent [19]

Kraus

[11] Patent Number: 4,922,834

[45] Date of Patent: May 8, 1990

[54] PALLET STORAGE SYSTEM FOR STORING CYLINDRICAL ARTICLES AND PALLET FOR USE THEREIN

[75] Inventor: Robert T. Kraus, Akron, Ohio

[73] Assignee: The Uniroyal Goodrich Tire Company, Akron, Ohio

[21] Appl. No.: 321,817

[22] Filed: Mar. 10, 1989

[51] Int. Cl.[5] ..... B65D 19/00

[52] U.S. Cl. ..... 108/51.1; 206/386

[58] Field of Search ..... 108/57.1, 53.1; 52/590; 248/346; 220/23.2, 23.4; 206/386

[56] References Cited

U.S. PATENT DOCUMENTS

| | | | |
|---|---|---|---|
| 3,645,215 | 2/1972 | Kirkpatrick | 108/57.1 X |
| 4,324,190 | 4/1982 | Hewitt | 108/51.1 |
| 4,730,732 | 3/1988 | Wagonseller | 108/51.1 X |
| 4,785,945 | 11/1988 | Rowse et al. | 108/64 X |

FOREIGN PATENT DOCUMENTS

| | | | |
|---|---|---|---|
| 1552705 | 9/1979 | United Kingdom | 206/386 |

*Primary Examiner*—Peter A. Aschenbrenner

*Attorney, Agent, or Firm*—Reese Taylor; Alan A. Csontos

[57] ABSTRACT

A system for storing cylindrical objects includes at least two article supporting pallets having mating projecting noses and oppositely disposed recesses. The pallets comprise at least upper deck boards for supporting the articles on the one hand and engaging a supporting surface such as a floor on the tops of risers or other vertically disposed restrainers on the other hand. The projecting noses and opposed recesses are preferably tapered for ease of alignment. The pallet is dimensioned so that the pallet has a width dimension approximating two and three quarters the diameter of a selected article, a length dimension approximating two diameters of the selected article and the nose projects approximately one half the diameter of the selected article. The system also encompasses the use of a series of pallet sizes, wherein each pallet differs from the other by about 15 percent in size, which permits the user to achieve optimal storage density for a broader range of diameters for such articles.

2 Claims, 5 Drawing Sheets

PALLET STORAGE SYSTEM FOR STORING CYLINDRICAL ARTICLES AND PALLET FOR USE THEREIN

BACKGROUND OF THE INVENTION

This invention relates, in general, to the storage of cylindrical or toroidal articles and relates, in particular, to a storage system designed for the efficient and effective storage of stacks of tires.

DESCRIPTION OF THE PRIOR ART

Various cylindrical or toroidal articles are commonly stored on pallets which are, in turn, then stored in warehouses. By way of example, vehicular tires are commonly warehoused for various reasons. Millions of tires may be warehoused at any given time, and such storage requires the utilization of costly warehouse space. The efficient use of such space is therefore a highly desirable objective.

Conventionally, tires are often stored by stacking them on flat pallets with vertically disposed riser tubes inserted into the centers of the stacks for stability. Another style of pallet also commonly utilized includes vertical restraining members such as integral pipe or square tubing disposed on the peripheries of the pallets and with the tires being stacked within the frame formed by the restraining members. In either case, similar pallets may then be stacked one upon the other so as to utilize the available cubic storage space to its utmost.

The optimum number of articles such as tires of a given diameter, for example, which can be stored in a given space using prior art systems can be readily calculated. Just by way of example, one pallet commonly used is square in planar configuration, measuring 60 inches by 60 inches. For tires with diameters less than 24.86 inches, five stacks can be placed on the pallet without the stacks of tires overhanging the edge of the pallet. The area occupied by these tires would be 60 inches or 3600 square inches. For diameters greater than 24.86 inches, five stacks can be placed on the pallet, but the tires will overhang the edge of the pallet and require a larger rectangular area with the sides equal to the diameter times a constant (approximately 2.41). For tires with diameters greater than 27 inches, only four stacks of tires can be placed on the pallet. These tires would occupy an area again of 3600 square inches. For tires greater than 30" in diameter, the stacks will overhang the pallet and a rectangular area with sides of 2 times the tire diameter would be required.

In all of these cases, the stacks of tires are typically 6 to 9 tires high on a pallet. Pallets are stacked five high by using cardboard tubes or vertical restraining members as previously mentioned.

Computations can be made for tires of varying sizes with the point being that, with any storage system, a finite number of tires can be effectively stored in a given space and it is an object of this invention to provide a system which will increase the capacity of such storage space.

By way of further background, the patent prior art illustrates several versions of essentially square or rectangular pallets of the type just described and used for storing tires, drums, pipes or similar cylindrical or toroidal articles.

Thorne U.S. Pat. No. 3,012,663 shows a tire storage pallet utilizing a conventional square pallet configuration with internal columns or riser tubes. Skubic U.S. Pat. No. 3,265,224 is of general interest, showing a four stack pallet for tires with stack stabilizers, while Gallagher U.S. Pat. No. 4,290,370 is of some interest in showing a six stack pallet load. Naylor U.S. Pat. No. 3,431,870 discloses a trapezoidal pallet intended to store three cylindrical articles, again such as shipping drums.

Also of general interest are Budd U.S. Pat. No. 2,594,287; Nordgren U.S. Pat. No. 4,051,786; Lequeux U.S. Pat. No. 4,118,855; and Persson U.S. Pat. No. 4,208,971. These patents generally relate to means for securing the articles on the pallets which are then presumably arranged in conventional fashion.

In addition to the foregoing, attempts have been made to maximize the utilization of storage space for articles having configurations similar to those referred to in this application. Examples of such patent prior art can be seen, for example, in Phelps U.S. Pat. No. 3,710,732, which discloses a T-shaped pallet, or one having a curvilinear shape, which is employed for the storage of cylindrical drums to more efficiently utilize the available storage space.

Weinmann U.S. Pat. No. 3,834,323 shows an open frame type pallet for storage of drums, and also employs a generally T-shaped arrangement for a three-drum array.

Van Gompel U.S. Pat. No. 4,403,556 is also of similar interest in that it discloses an essentially hexagonal pallet or platform, also designed for the storage of drums and wherein the same are compactly arrayed, as can be seen in the drawings.

While tires and similarly configured articles have been stored for years using square pallets and arranging the pallets in stacks and by using other configurations, as just described by way of example, there is some question as to whether any of the known systems make optimum use of available space.

Thus, it is believed that while the prior art just referred to may be suitable for the purposes for which it is designed, a more efficient storage system and pallet design and concept can be achieved by providing a pallet having a unique planar configuration which will permit adequate support for the tires or other objects stored thereon, but will provide maximum improved efficient usage of the storage space available and thereby reduce the space required to store a given number of articles with a readily apparent corresponding reduction in cost. Production of unique pallets and use of them in an orderly system thus becomes the principal object of this invention.

SUMMARY OF THE INVENTION

It has been found that the use of an improved pallet storage system can reduce needed floor space by approximately ten percent or more. The actual reduction is dependent on: the diameter distribution of the inventory of articles stored, the number of improved pallet sizes utilized, and warehousing practice such as the amount of clearance between rows of pallets. A sample calculation, using one pallet size, equivalent warehousing practice, and an actual tire inventory shows a 11.42 percent increase in density. The economic ramifications of such an increase will be readily apparent.

The improved pallet storage system can be produced by utilizing a reversible, double-faced pallet with substantially parallel side edges and substantially parallel front and back edges. The pallet, moreover, has a recessed tail area extending inwardly from its rear edge and a projecting nose area extending outwardly from its front or leading edge, so as to accommodate the optimum number of tires or other articles with adequate support over a wide range of sizes and so that adjacent pallets can nest with each other for more efficient usage of the floor space.

It has also been found that by providing the recessed area with tapering walls and the projecting nose with complementary tapering walls, nesting is enhanced and alignment problems are minimized.

It has further been found that the uniquely designed pallets can be physically sized using simple calculations to yield the preferred dimensions for a supply of pallets that correspond to the diameter of the articles. Thus, where the article diameter is D, the distance from the rear edge to the front or leading edge of the pallet will be about 2D and the distance between the side edges will be about 2.75D. The nose will project about 0.5D and such dimensions will provide a pallet on which a layer of articles may be placed in circumferential abutment with each other and with the tires adjacent the lateral edges of the pallet tangential with the planes of the side edges.

Where a range of article sizes must be accommodated, the storage system of this invention permits one to calculate and employ the physical sizes of the pallets which again maximize efficient use of floor space. For example, given a population of different tire sizes and diameters, the physical size of a pallet is based on D, the diameter of a given tire. However, the unique pallet design permits efficient stacking of tires on this pallet for tires having diameters ranging from D to 1.15 times D. Hence, for one physical pallet size, the inventive storage system efficiently accommodates all tires having a diameter within the range of D to 1.15D. For tires having a diameter beyond 1.15D, the physical size of the next series of pallets would be based on D, and pallets sized as such can then efficiently store all tires having a diameter from D to 1.15D. This method can be repeated as often as necessary so that the uniquely designed pallet can be physically sized to produce an efficient storage system for the entire population of tire sizes. Each pallet size would differ from the other by about 15% in dimensions, so that, if, for example, the ranges of tire diameters from smallest to largest was about 60%, then four pallets, each having the unique design but each of a select physical size, would provide maximum utilization of the storage space.

It has been found that any range may be accommodated by providing a system comprising a series of pallet sizes, each increased in size by about 15%, as noted. However, where economic or other reasons preclude maintaining a stock of pallets of multiple sizes, the optimal size may be determined by utilizing a weighted average to ascertain dimension D.

Accordingly, production of an improved pallet storage system for supporting cylindrical objects and a pallet for use therein of the character above described becomes the principal object of this invention with further objects thereof becoming more apparent upon a reading of the following brief specification considered and interpreted in view of the accompanying drawings.

OF THE DRAWINGS

BRIEF DESCRIPTION OF THE PREFERRED EMBODIMENTS

Before describing the invention in detail, it should be noted that the following specification and the drawings will refer to the storage of tires for ease of illustration and simplicity of description. However, the invention is not intended to be so limited and is believed to have utility with respect to a wide variety of articles that can be projected into a plane with the projection having an approximately circular perimeter.

Figure 1:
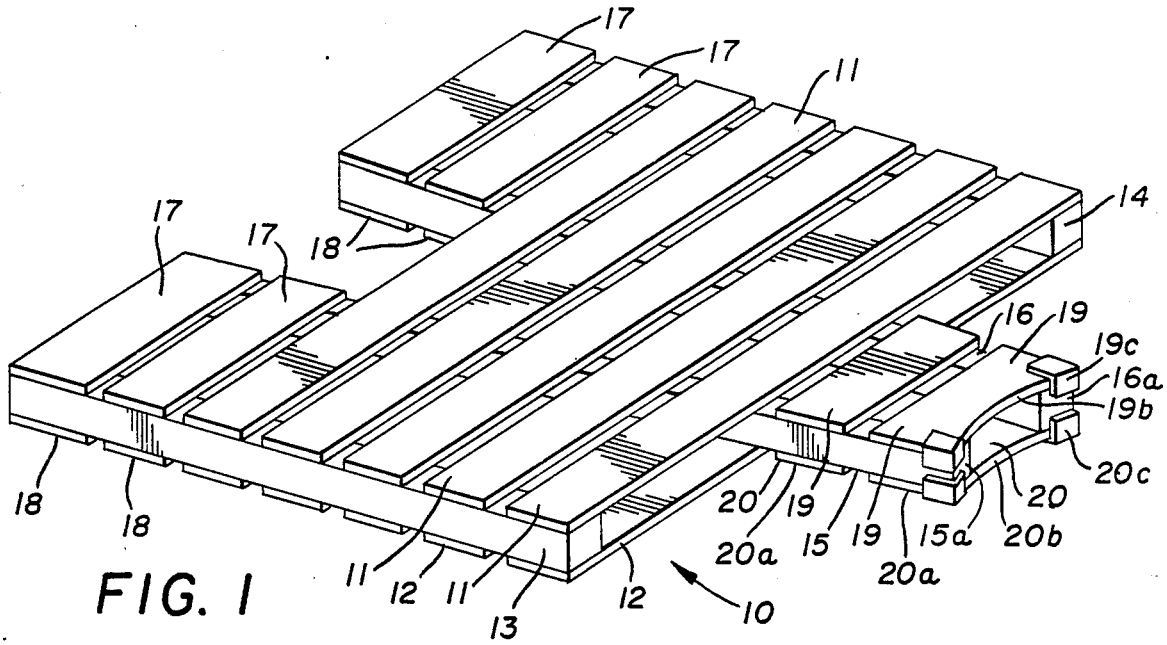
FIG. 1 is a perspective view of the improved pallet.

Referring first then to FIG. 1 of the drawings, it will be seen that the pallet, generally indicated by the numeral 10, is a pallet of the reversible type so that it has utilization regardless of which deck boards are in contact with a supporting surface. Thus, for purposes of illustration and description, Applicant will refer to top deck boards and bottom deck boards, but, in the form of the invention illustrated, the reversibility of the pallet should be kept in mind. However, as will be noted subsequently, the inventive concept does not necessarily require reversibility.

Figure 2:
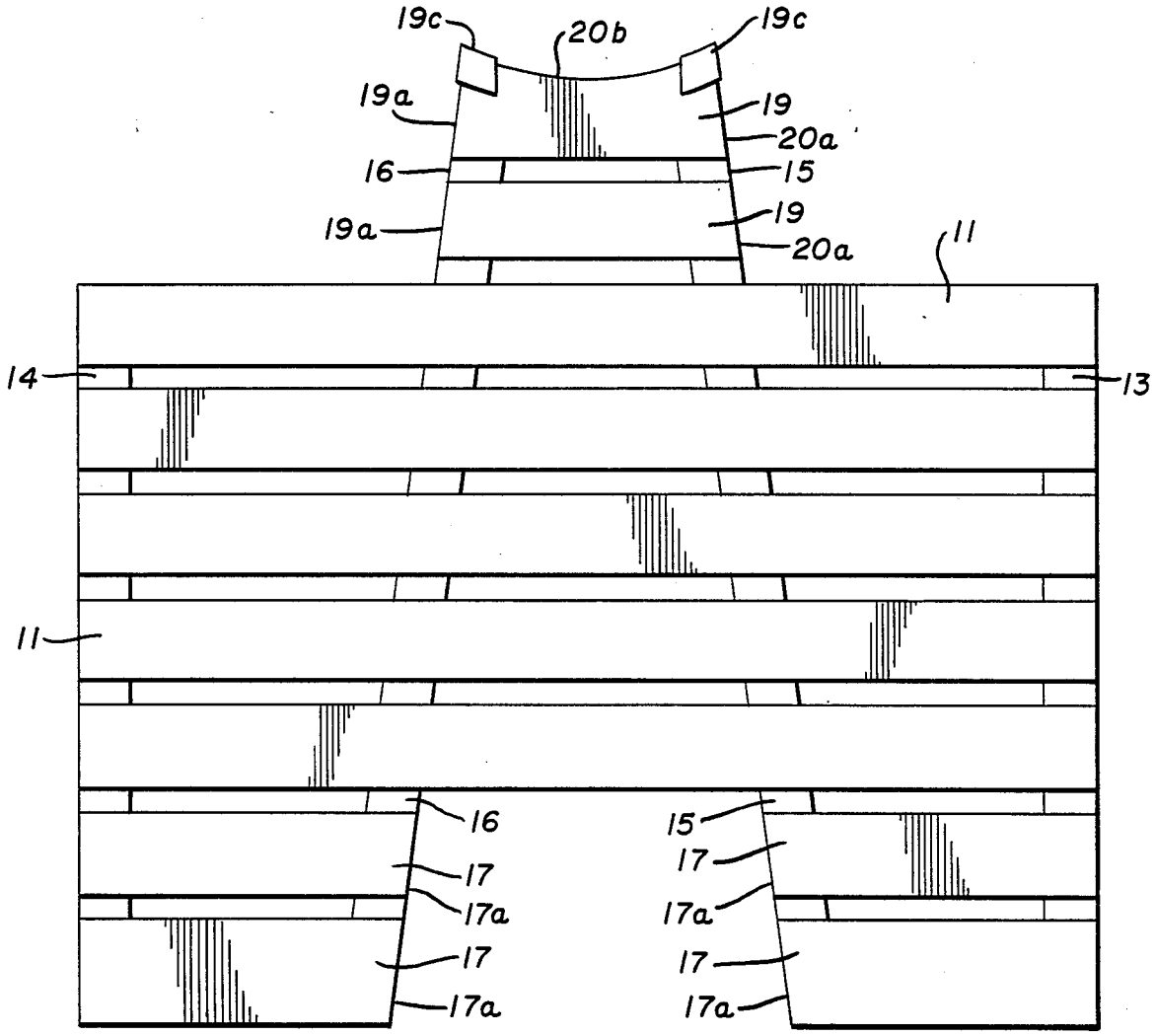
FIG. 2 is a top plan view thereof.

Still referring to FIG. 1 then, it will be seen that the pallet comprises a plurality of top main deck boards 11,11 and a plurality of bottom main deck boards 12,12. These boards are secured to outer risers 13 and 14 which, as can be seen in FIG. 2 of the drawings, are essentially disposed in parallel, spaced relationship.

The deck boards 11,11 and 12,12 span the distance between the risers 13 and 14, or from side to side of the pallet, and can be secured thereto by any suitable means, such as nailing, gluing, stapling, etc.

Disposed inboard from or between the outer stringers 13 and 14 are inner stringers 15 and 16. These stringers extend (see FIG. 2) from the rear edge to the leading edge of the pallet and beyond. In that regard, for purposes of reference, the end of the pallet to the right of FIG. 1 will be referred to as the front or leading edge and the end to the left of FIG. 1 as the rear edge.

The inner stringers 15 and 16 are disposed at an angle with respect to the longitudinal center line of the pallet so that their widest spacing is at the rear edge of the pallet 10 and their forward ends 15*a*,16*a* converge toward each other as they extend toward and past the leading edge of the pallet.

At the rear of the pallet, top tail deck boards 17,17 are secured to both the risers 13 and 14 and the risers 15 and 16. These span the distance between the risers and 13 and 15 on the one hand and 14 and 16 on the other and are attached thereto as just noted with regard to main deck boards 11 and 12. As can be seen in FIG. 2, the inner edge surface of the top tail deck boards are cut at an angle as indicated at 17a,17a so as to conform to the edges of the inner risers 15 and 16.

At the front or leading edge of the pallet 10, the risers 15 and 16 also support top nose deck boards 19,19 and bottom nose deck boards 20,20. These are again secured to the risers 15 and 16 by any suitable means, as already described. Furthermore, the outer edge surfaces 19a,19a and 20a,20a are cut at an angle so as to be flush with the plane of the outer edge of the risers 15 and 16, as can be clearly seen in FIG. 2 of the drawings.

The forwardmost top and bottom nose deck boards 19 and 20 also have a concave edge surface indicated at 19b and 20b. The purpose of this configuration will be described more fully below. It is also possible to cap the pointed edges of the nose as at 19c,19c and 20c,20c with protective members to protect against damage since such damage may reduce the effectiveness of the invention, as will become apparent.

Figure 3:
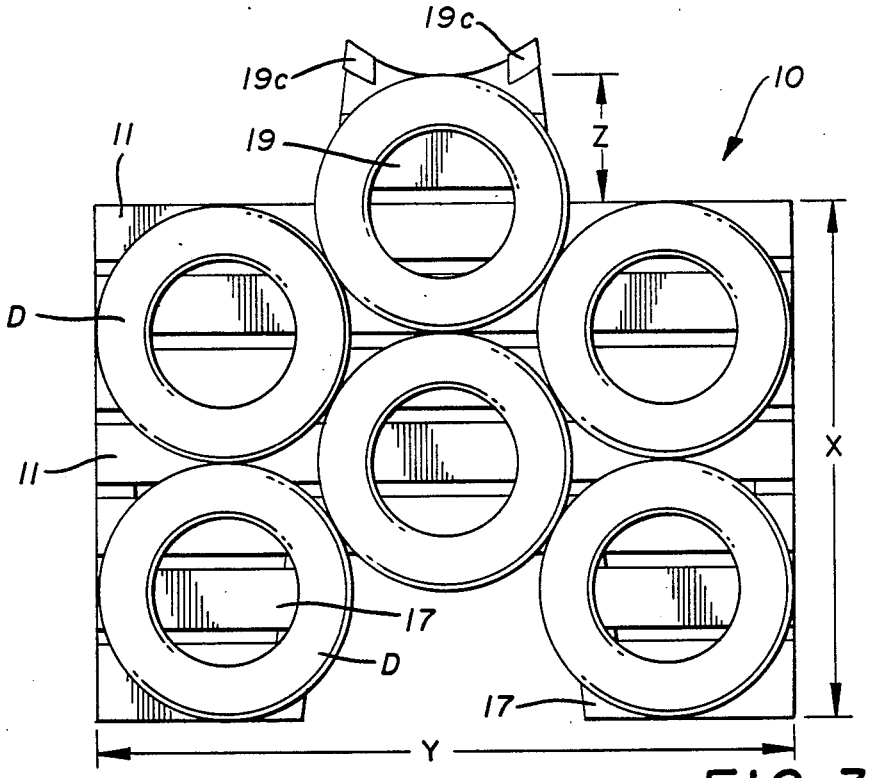
FIG. 3 is a top plan view of the pallet of the present invention showing six tires of the smaller size (D) described herein in place thereon.
Figure 4:
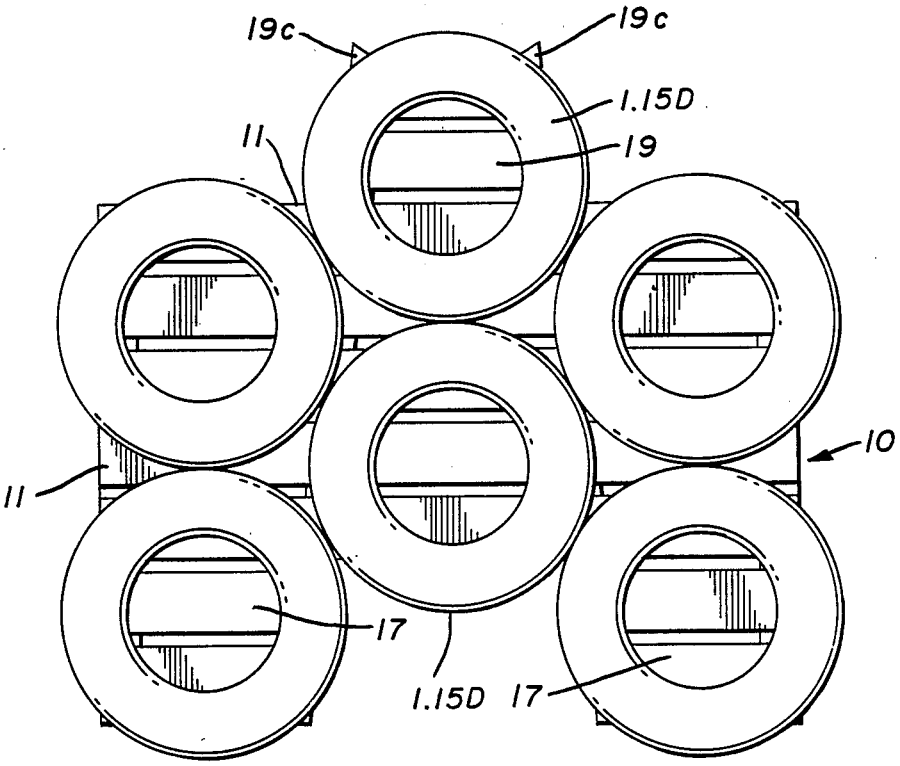
FIG. 4 is a top plan view of the pallet of this invention showing six tires of the larger size (1.15D) described herein in place thereon.

Turning next to FIGS. 3 and 4 of the drawings, it will be seen that a typical pallet 10 will support six stacks of tires, ranging from a smaller type identified as D to a larger type designated as 1.15D. While the invention is not intended to be limited to any particular absolute dimensions or to the storage of any particular size tire, for purposes of illustration, the small tires D may be those with a diameter of approximately 26 inches, while the large tires 1.15D may be those with a diameter of approximately 29.1 inches. Tires having a diameter ranging from D to 1.15D will be efficiently stored on this pallet. Larger or smaller diameter tires could also be stored on a pallet dimensioned for this size range, although some sacrifice in efficiency may result unless a second pallet size is also selected, as will be described.

One of the objects of the invention is to provide for "perfect nesting" of the stored tires. By perfect nesting, Applicant intends that the pallet is configured and dimensioned so that, for a given range of tire sizes, the tires of each layer will be in circumferential abutment with one or more other tires in the layer and at least tangent to the edges of the pallet. In this way, when pallets are adjacent each other, the points of interference are the articles and not the pallets.

Figure 5:
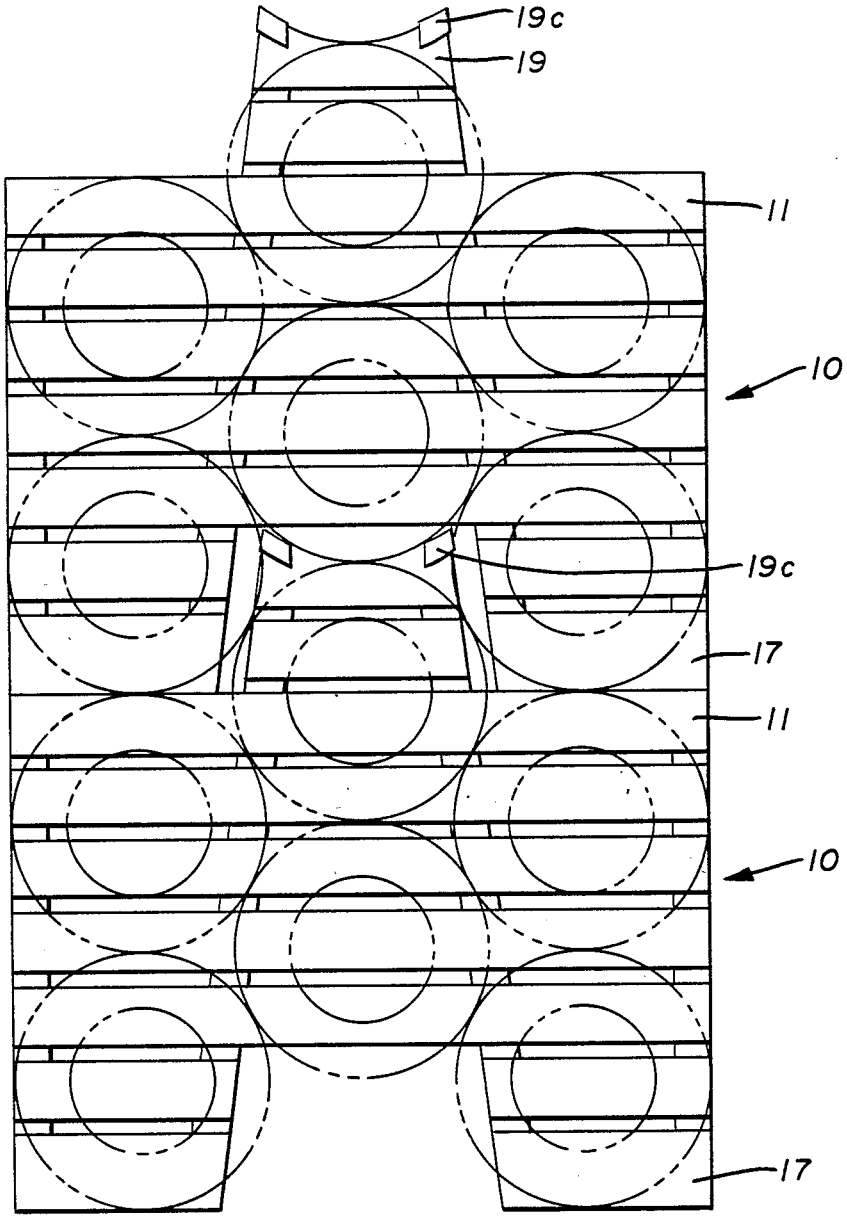
FIG. 5 is a partially schematic top plan view showing the nesting of two adjacent pallets carrying the smaller size (D) tires.
Figure 6:
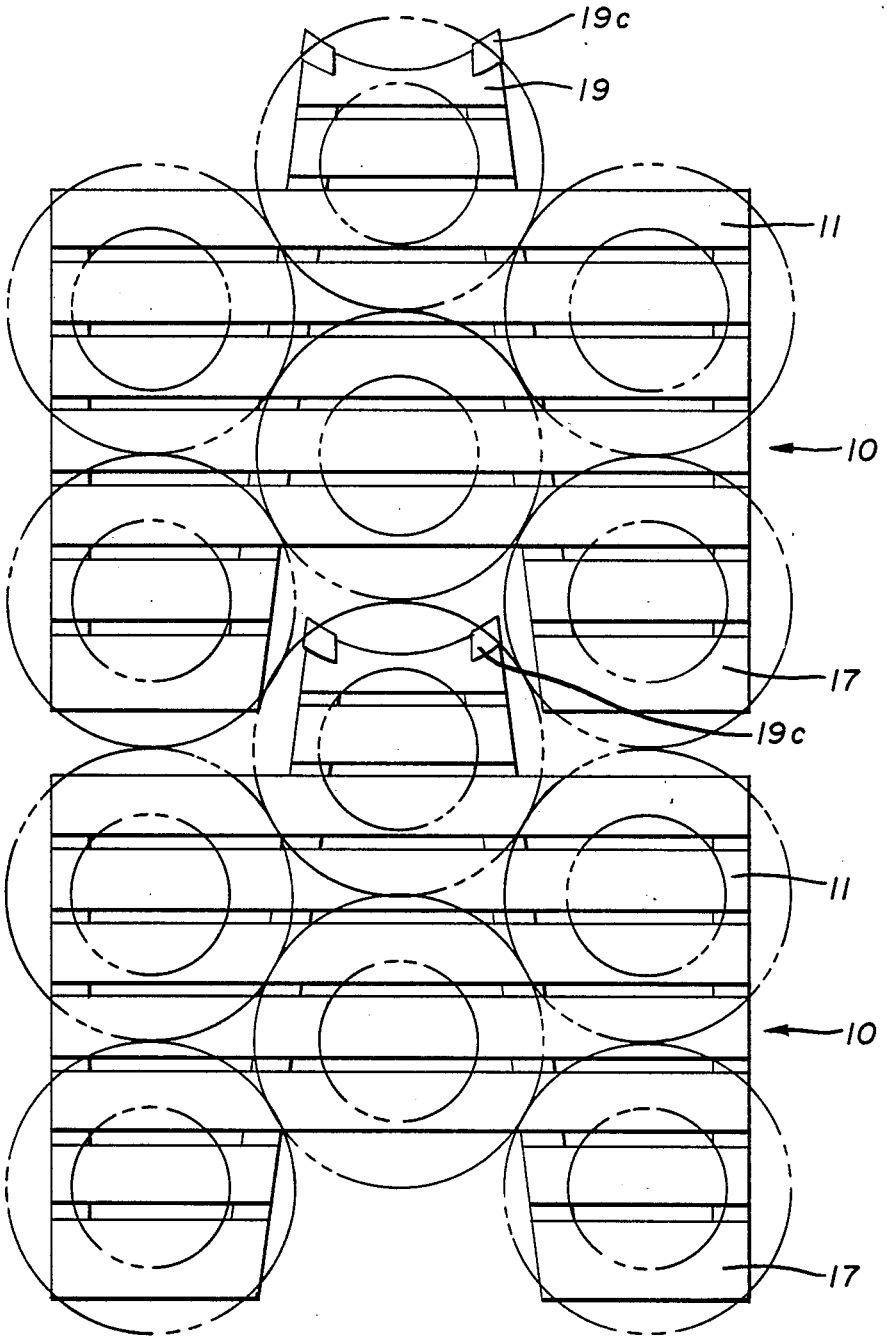
FIG. 6 is a partially schematic top plan view showing the nesting of two adjacent pallets bearing the larger size (1.15D) tires described herein.

In that regard, normal storage practice is to leave some small space between laterally adjacent pallets for ease of manipulation. Therefore, Applicant's reference to adjacent pallets connotes front-to-rear adjacency as illustrated in FIGS. 5 and 6.

Referring again, then, to FIGS. 3 and 4 of the drawings, it will be seen that six layers of tires of the range of diameters D to 1.15D can be efficiently stored on each pallet illustrated. The tires are in circumferential abutment with each other in both instances and at least tangential to the outer edges of the pallets. With the smaller tires D, these tires are essentially confined within the perimeter of the pallet and entirely supported on the pallet surface, resting on the top boards 11, 11, 17 and 19.

With regard to the larger tires 1.15D, these tires again are essentially fully supported in all important aspects on the deck boards 11, 11, 17 and 19 and are in circumferential abutment with each other. In that regard, it should be noted that, in a typical tire, the circumferential area of the sidewall is the breaker area. These breakers act as a beam and, due to the relative dimensions of the larger tires 1.15D and the pallet 10, in FIG. 4 of the drawings, the five outer tires overhang the edge of the pallet, but are supported in the breaker area and, therefore, multiple tires can be stacked in each stack with the stack being stably supported by the pallet itself through the beam-like breakers. It is also with this in mind that the corners of the nose may be protected by caps 19c,19c, so as to avoid damage to the corners and insure support for the forwardmost tire in the breaker area.

To arrive at a suitable pallet size to achieve perfect nesting for a range of tire sizes, the range must first be determined. Optimally, if the diameter of the smallest tire is D, and the diameter of the largest tire is 1.15D, tires falling within this range may be stored achieving maximum density on a pallet dimensioned as follows. Thus, and referring to FIG. 3, the dimension X, from the leading edge to the rear edge, will be about 2D. The dimension Y, from side to side, will be about 2.75D. Finally, the dimension Z, from the leading edge to a line extended from the apex of arcuate area 20b, will be about 0.5D.

D size tires fit perfectly on a pallet dimensioned as just described, as can be seen in FIG. 3 where the tires are in circumferential abutment with each other and where the outermost rows are tangent to the planes of the side, rear and leading edges.

1.15D size tires overhang, as shown in FIG. 4. However, they are all adequately supported in the breaker area as has been explained.

As can be seen in FIG. 5 of the drawings, with the smaller tires D, it is possible to store six tires efficiently on the pallet and then nest the pallet with another pallet, thereby obtaining optimum usage of the available storage space. In other words, the nose on the leading edge of one pallet will fit into the recessed area in the rear edge of the tail of the other pallet. The angular or tapered nature of the nose and recessed area makes this possible without requiring tedious or difficult alignment maneuvers.

FIG. 6 illustrates nesting with the larger diameter tire 1.15D wherein, while the front and rear edges of the pallets do not abut, the tires do abut and are efficiently supported and optimum usage of the space is achieved.

Tires larger than the 1.15D diameter stored on a pallet of the relative size of that illustrated in FIG. 4 of the drawings will not nest in the fashion illustrated. Three tires only can be stored, thereby reducing efficiency.

While this may not present a serious problem, if a substantial part of the typical inventory is likely to fall above the 1.15D end of the range, a different pallet size is called for. The storage system of this invention readily permits one to design and utilize a second pallet size based on a tire having a diameter of D. Hence, a second population of tires having diameters ranging from D to 1.15D can be efficiently stored using the present invention. This can be repeated as many times as needed to design pallets based on D dimensions (or D″ and so on) and thereby obtain pallet sizes that cover the population of tires from the smallest to the largest diameter tires. The size range of the tires from D to D should be about 15% (although it can be greater) to use the system most effectively.

Similarly, with tires smaller than the D diameter, the arrangement in FIG. 3 is still possible, although here there still would be only six tires supported on the pallet and the result will be less than the "perfect" nesting referred to above. Again, if a substantial part of the typical inventory is likely to fall below the D end of the range, a new pallet size can be accommodated by redesign as just described.

Thus, as previously noted, it is contemplated that the pallet dimensions of a typical system would be determined by the diameter profile of the inventory to be accommodated. In other words, the relative dimensions of the pallets illustrated in the drawings are those which are most efficient for a given inventory diameter profile, which is the distribution of diameters in a given inventory and wherein the bulk of the tires to be stored are between D and 1.15D in diameter. If the inventory were otherwise, a different pallet size would bring optimum results.

In that regard, if economically feasible, it may be desirable, where the diameter profile at the storage site fluctuates, to stock a series of sizes of pallets. Thus, starting with a base size range D to 1.15D, each successive pallet would be increased in size by about 15% to thereby accommodate a wide variation in ranges.

The improved pallet storage system has previously been indicated as increasing density in a typical, and actual, situation by 11.42 percent, as illustrated in the following table:

TABLE 1

| | | | Sample Calculation-Percent Increase In Density Using A Sample Inventory | | | | | | | |
|---|---|---|---|---|---|---|---|---|---|---|
| | | | 60 × 60 | | | HDP | | | Comparison | |
| Tire Dia | Number of Tires | Percent of Total | Area For 5 On 60 × 60 | Number of Tires | Tires per Sq. Foot | Area For 6 on HDP | Number of Tires | Tires per Sq. Foot | Percent Increase | Weighted Percent Increase |
| 21.76 | 789 | 0.7 | 160.00 | 875.00 | 5.47 | 183.03 | 1050.00 | 5.74 | 0.05 | 0.03 |
| 22.6 | 504 | 0.4 | 160.00 | 875.00 | 5.47 | 183.03 | 1050.00 | 5.74 | 0.05 | 0.02 |
| 22.74 | 283 | 0.2 | 160.00 | 875.00 | 5.47 | 183.03 | 1050.00 | 5.74 | 0.05 | 0.01 |
| 22.76 | 5707 | 4.8 | 160.00 | 875.00 | 5.47 | 183.03 | 1050.00 | 5.74 | 0.05 | 0.24 |
| 22.82 | 775 | 0.7 | 160.00 | 875.00 | 5.47 | 183.03 | 1050.00 | 5.74 | 0.05 | 0.03 |
| 23.08 | 663 | 0.6 | 160.00 | 875.00 | 5.47 | 183.03 | 1050.00 | 5.74 | 0.05 | 0.03 |
| 23.2 | 159 | 0.1 | 160.00 | 875.00 | 5.47 | 183.03 | 1050.00 | 5.74 | 0.05 | 0.00 |
| 23.28 | 51 | 0 | 160.00 | 875.00 | 5.47 | 183.03 | 1050.00 | 5.74 | 0.05 | 0.00 |
| 23.29 | 2226 | 1.9 | 160.00 | 875.00 | 5.47 | 183.03 | 1050.00 | 5.74 | 0.05 | 0.09 |
| 23.42 | 4617 | 3.9 | 160.00 | 875.00 | 5.47 | 183.03 | 1050.00 | 5.74 | 0.05 | 0.19 |
| 23.5 | 566 | 0.5 | 160.00 | 875.00 | 5.47 | 183.03 | 1050.00 | 5.74 | 0.05 | 0.02 |
| 23.9 | 119 | 0.1 | 160.00 | 875.00 | 5.47 | 183.03 | 1050.00 | 5.74 | 0.05 | 0.00 |
| 23.93 | 1 | 0 | 160.00 | 875.00 | 5.47 | 183.03 | 1050.00 | 5.74 | 0.05 | 0.00 |
| 24.02 | 3625 | 3 | 160.00 | 875.00 | 5.47 | 183.03 | 1050.00 | 5.74 | 0.05 | 0.15 |
| 24.23 | 2085 | 1.8 | 160.00 | 875.00 | 5.47 | 183.03 | 1050.00 | 5.74 | 0.05 | 0.09 |
| 24.31 | 3036 | 2.5 | 160.00 | 875.00 | 5.47 | 183.03 | 1050.00 | 5.74 | 0.05 | 0.12 |
| 24.5 | 758 | 0.6 | 160.00 | 875.00 | 5.47 | 183.03 | 1050.00 | 5.74 | 0.05 | 0.03 |
| 24.65 | 2939 | 2.5 | 160.00 | 875.00 | 5.47 | 183.03 | 1050.00 | 5.74 | 0.05 | 0.12 |
| 24.8 | 186 | 0.2 | 160.00 | 875.00 | 5.47 | 183.03 | 1050.00 | 5.74 | 0.05 | 0.01 |
| 24.86 | 2920 | 2.5 | 160.00 | 875.00 | 5.47 | 183.03 | 1050.00 | 5.74 | 0.05 | 0.12 |
| 24.92 | 1035 | 0.9 | 160.00 | 875.00 | 5.47 | 183.03 | 1050.00 | 5.74 | 0.05 | 0.04 |
| 24.96 | 6873 | 5.8 | 160.00 | 875.00 | 5.47 | 183.03 | 1050.00 | 5.74 | 0.05 | 0.28 |
| 25.02 | 1020 | 0.9 | 160.00 | 875.00 | 5.47 | 183.03 | 1050.00 | 5.74 | 0.05 | 0.04 |
| 25.17 | 1496 | 1.3 | 162.20 | 875.00 | 5.39 | 183.03 | 1050.00 | 5.74 | 0.06 | 0.08 |
| 25.4 | 276 | 0.2 | 164.85 | 875.00 | 5.31 | 183.03 | 1050.00 | 5.74 | 0.08 | 0.02 |
| 25.41 | 3728 | 3.1 | 164.96 | 875.00 | 5.30 | 183.03 | 1050.00 | 5.74 | 0.08 | 0.25 |
| 25.44 | 142 | 0.1 | 165.31 | 875.00 | 5.29 | 183.03 | 1050.00 | 5.74 | 0.08 | 0.01 |
| 25.51 | 25 | 0 | 166.12 | 875.00 | 5.27 | 183.03 | 1050.00 | 5.74 | 0.09 | 0.00 |
| 25.57 | 170 | 0.1 | 166.82 | 875.00 | 5.25 | 183.03 | 1050.00 | 5.74 | 0.09 | 0.01 |
| 25.64 | 683 | 0.6 | 167.63 | 875.00 | 5.22 | 183.03 | 1050.00 | 5.74 | 0.10 | 0.06 |
| 25.9 | 7060 | 5.9 | 170.68 | 875.00 | 5.13 | 183.03 | 1050.00 | 5.74 | 0.12 | 0.70 |
| 25.95 | 3126 | 2.6 | 171.27 | 875.00 | 5.11 | 183.03 | 1050.00 | 5.74 | 0.12 | 0.32 |
| 26 | 290 | 0.2 | 171.86 | 875.00 | 5.09 | 183.03 | 1050.00 | 5.74 | 0.13 | 0.03 |
| 26.08 | 1565 | 1.3 | 172.81 | 875.00 | 5.06 | 183.03 | 1050.00 | 5.74 | 0.13 | 0.17 |
| 26.14 | 14 | 0 | 173.52 | 875.00 | 5.04 | 183.03 | 1050.00 | 5.74 | 0.14 | 0.00 |
| 26.15 | 2130 | 1.8 | 173.64 | 875.00 | 5.04 | 183.03 | 1050.00 | 5.74 | 0.14 | 0.25 |
| 26.21 | 7426 | 6.2 | 174.35 | 875.00 | 5.02 | 183.03 | 1050.00 | 5.74 | 0.14 | 0.89 |
| 26.5 | 634 | 0.5 | 177.82 | 875.00 | 4.92 | 182.59 | 1050.00 | 5.75 | 0.17 | 0.08 |
| 26.63 | 1191 | 1 | 179.38 | 875.00 | 4.88 | 184.17 | 1050.00 | 5.70 | 0.17 | 0.17 |
| 26.74 | 284 | 0.2 | 180.71 | 875.00 | 4.84 | 185.52 | 1050.00 | 5.66 | 0.17 | 0.03 |
| 26.89 | 955 | 0.8 | 182.53 | 875.00 | 4.79 | 187.37 | 1050.00 | 5.60 | 0.17 | 0.14 |
| 27 | 208 | 0.2 | 183.87 | 875.00 | 4.76 | 188.73 | 1050.00 | 5.56 | 0.17 | 0.03 |
| 27.05 | 268 | 0.2 | 184.48 | 875.00 | 4.74 | 189.35 | 1050.00 | 5.55 | 0.17 | 0.03 |
| 27.13 | 29 | 0 | 185.46 | 875.00 | 4.72 | 190.34 | 1050.00 | 5.52 | 0.17 | 0.00 |
| 27.17 | 8092 | 6.8 | 185.95 | 875.00 | 4.71 | 190.84 | 1050.00 | 5.50 | 0.17 | 1.15 |
| 27.48 | 2516 | 2.1 | 160.00 | 700.00 | 4.38 | 194.72 | 1050.00 | 5.39 | 0.23 | 0.49 |
| 27.5 | 111 | 0.1 | 160.00 | 700.00 | 4.38 | 194.98 | 1050.00 | 5.39 | 0.23 | 0.02 |
| 27.68 | 8846 | 7.4 | 160.00 | 700.00 | 4.38 | 197.25 | 1050.00 | 5.32 | 0.22 | 1.60 |
| 28.02 | 747 | 0.6 | 160.00 | 700.00 | 4.38 | 201.58 | 1050.00 | 5.21 | 0.19 | 0.11 |
| 28.03 | 936 | 0.8 | 160.00 | 700.00 | 4.38 | 201.70 | 1050.00 | 5.21 | 0.19 | 0.15 |
| 28.1 | 90 | 0.1 | 160.00 | 700.00 | 4.38 | 202.60 | 1050.00 | 5.18 | 0.18 | 0.02 |
| 28.31 | 6 | 0 | 160.00 | 700.00 | 4.38 | 205.30 | 1050.00 | 5.11 | 0.17 | 0.00 |
| 28.5 | 8911 | 7.5 | 160.00 | 700.00 | 4.38 | 207.77 | 1050.00 | 5.05 | 0.16 | 1.16 |
| 28.7 | 183 | 0.2 | 160.00 | 700.00 | 4.38 | 210.37 | 1050.00 | 4.99 | 0.14 | 0.03 |
| 28.86 | 18 | 0 | 160.00 | 700.00 | 4.38 | 212.47 | 1050.00 | 4.94 | 0.13 | 0.00 |
| 28.89 | 16020 | 13.4 | 160.00 | 700.00 | 4.38 | 212.86 | 1050.00 | 4.93 | 0.13 | 1.71 |
| | 119113 | | | | | | | Total Percent Increase | | 11.42 |

For purposes of preparing this table, which illustrates a typical gain in density using the high density pallet (HDP), an area equal to one-half the width of the access aisle times the required pallet opening width has been included in the density calculation. Also, normal warehouse practice includes a clearance between openings for rows of pallets. In preparing the table, a zero clearance was used in the calculations and it should be noted that this actually tends to understate the density increase because the typical 60 inch by 60 inch pallets would require more of these clearances for the pallets stored.

Finally, a five pallet row depth was used in the calculations. Again, this tends to understate the density increase since greater row depths, which are often used, would result in a greater density increase.

It is readily apparent from this table that significant savings can be achieved utilizing the inventive concept.

In that regard, it will be noted that the nose of the preferred embodiment has been illustrated as tapering and having a tapering recess in the rear edge so as to facilitate nesting. It is possible to achieve this advantage with a modified embodiment of the invention, as illustrated in FIGS. 7 and 8 of the drawings.

Figure 7:
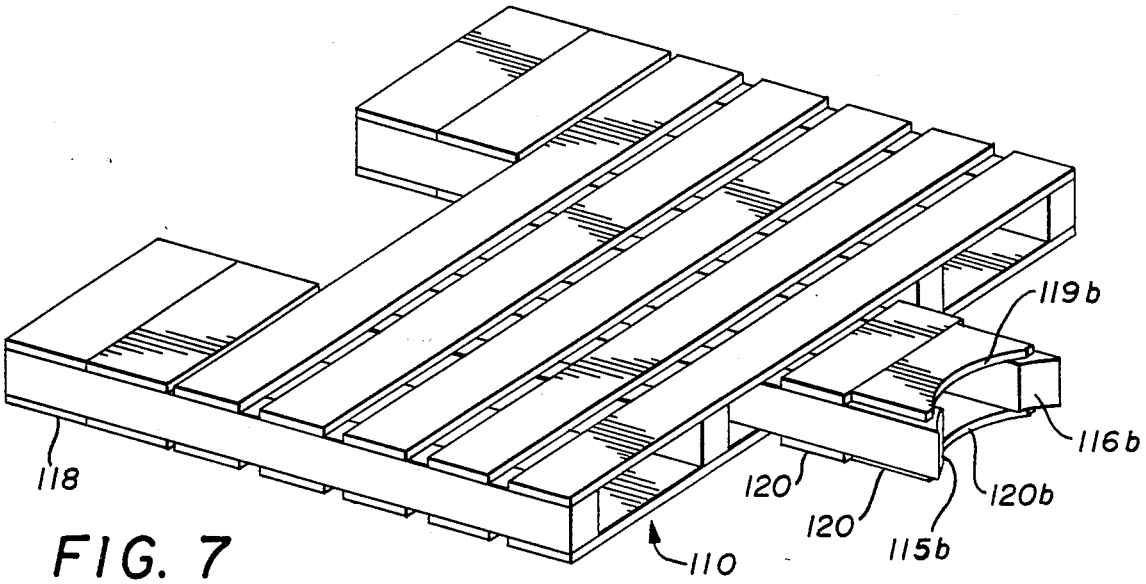
FIG. 7 is a perspective view of an alternative embodiment of the improved pallet.
Figure 8:
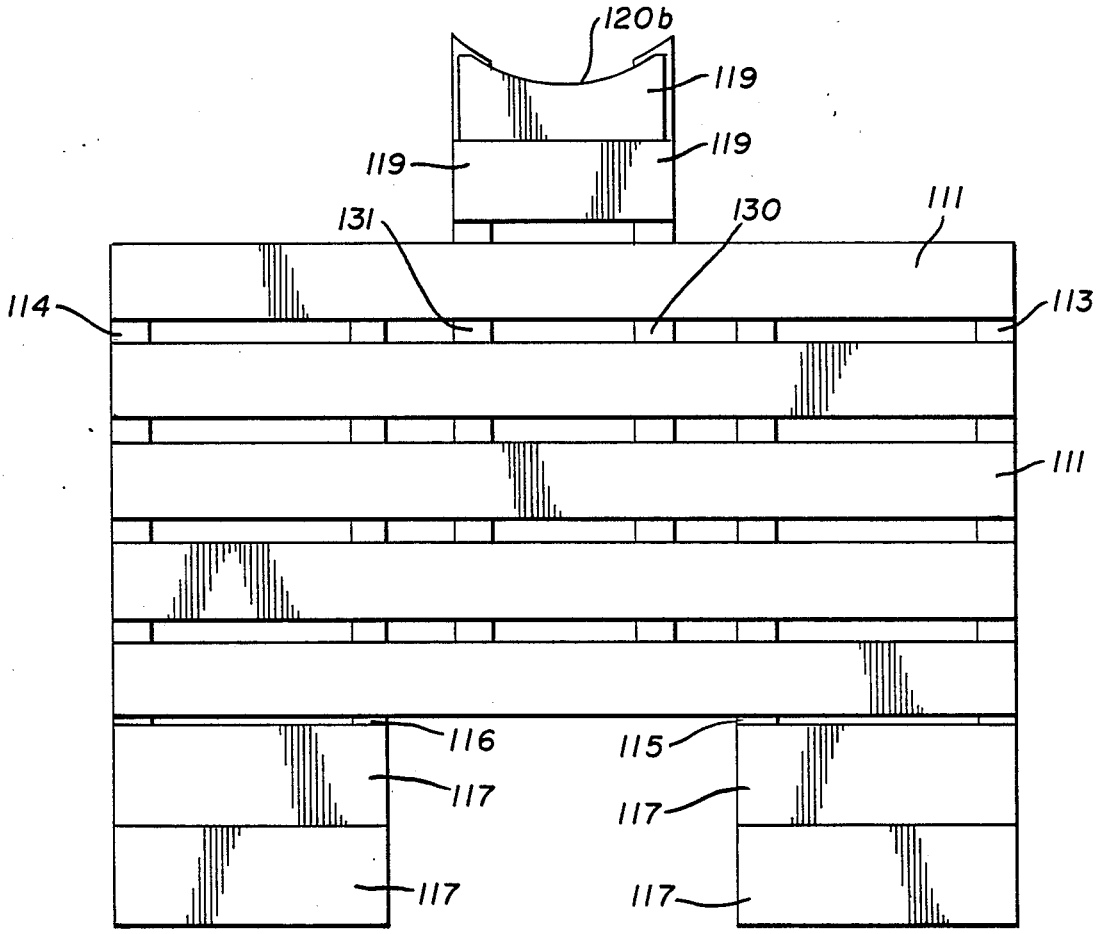
FIG. 8 is a top plan view of the alternative embodiment of FIG. 7.

In that regard, it will be noted that this embodiment of the invention, generally indicated by the numeral 110, is also illustrated as a reversible type and comprises a plurality of top main deck boards 111,111 and bottom main deck boards 112,112 with these boards being secured to outer risers 113 and 114, as can be seen in FIGS. 7 and 8 of the drawings.

These deck boards span the distance between the risers and can be secured thereto by suitable means already referred to.

Disposed inboard between the outer stringers 113 and 114 are first inner stringers 115 and 116. It is assumed that the top and bottom deck boards would be secured to these risers as well.

In contrast to the form of the invention illustrated in FIGS. 1 through 6 of the invention, in this form of the invention, the first inner stringers 115 and 116 are disposed parallel to the outer stringers 113 and 114. Top tail deck boards 117,117 are secured on the risers 113,114 and 115,116, as are bottom tail deck boards 118,118. It will be noted, however, that these deck boards are relatively short and that a space is provided between the tail ends of the risers 115 and 116 for accommodation of the nose of the next adjacent pallet, as will be described.

In the form of the invention illustrated in FIGS. 7 and 8 of the drawings, a second pair of inner risers 130 and 131 are also provided. These extend from the rear edge of the rearmost deck board 111 and project outwardly from the front edge of the forwardmost top deck board 111 so as to provide support for the nose means of the invention. Here again, top and bottom nose deck boards 119 and 120 are affixed and the front edge presents a radiused area **120*b* with the front edges of the second inner risers 130 and 131 being tapered as at 130*b* and 131*b*. It will be seen then that the spacing between the risers 130 and 131 is significantly less than the spacing between the first inner risers 115 and 116**. This has the effect of presenting a recess in the rear edge of the pallet which is sufficiently greater in width dimension than the width of the nose which is intended to be inserted therein. Therefore, while the preferred embodiment shows a tapered nose and a tapered walled recess to facilitate nesting, nesting can also be accomplished in this fashion.

It will be understood that the utilization of the pallet in a storage system, as already described with regard to the form of the invention illustrated in FIGS. 1 through 6 of the drawings, will be the same.

While a full and complete description of the invention has been set forth in accordance with the dictates of the Patent Statutes, it should be understood that modifications can be resorted to without departing from the spirit hereof or the scope of the appended claims.

Thus, as already has been noted, no precise dimensions as to the size of the pallets have been given, since that would be dictated by the size population of the universe of tires to be stored in a given facility. As has been mentioned, the pallet size chosen is the one which gives the optimum density increase. However, the principle of the nesting of the pallets would remain constant regardless of the relative size thereof.

Additionally, while reference has been made herein to "boards", it will be understood that the pallet 10 could be constructed of any suitable material having the strength requirements to support the articles to be supported thereon.

It will also be understood that only a base layer of tires has been illustrated. For example, and as previously mentioned, as is well-known in the trade, the tires can receive riser tubes and the pallets may be stacked vertically. This structure and arrangement have been eliminated from the drawings for ease of illustration. Of course, when the pallets are thus stacked, the lower deck boards of a given pallet will rest on the top of risers rather than on the floor and the reversible nature of the embodiment illustrated provides the necessary surface area.

Also, as has been noted, the pallets have been illustrated and described as being reversible with opposed top and bottom deck boards. The inventive principles of the invention could also, however, be utilized with a pallet without a full lower deck where pallets having peripherally disposed, vertically extending restraining means are employed.

What is claimed is:

1. A pallet for supporting cylindrical or toroidal articles, comprising:

(a) a deck for supporting the objects and having a planar configuration with parallel opposed side walls and first and second ends;

(b) said first end having a centrally disposed projecting portion;

(c) said second end having a centrally disposed recess;

(d) said centrally disposed projecting portion of said first end having opposed side edges which converge as they project from said first end; and (e) said centrally disposed projection terminating in a transversely extending concave surface.

2. A system for the storage of cylindrical or toroidal articles, comprising:

(a) at least two article supporting pallets;

(b) each of said pallets having a leading edge and a rear edge;

(c) each of said pallets having a nose projecting beyond its leading edge;

(d) each of said pallets having a recess formed in its rear edge for receipt of the nose of an adjacent pallet; and (e) said noses of said pallets terminating in transversely extending concave surfaces when viewed in plan.

* * * * *